United States Patent [19]

Ehrlich

[11] 4,189,270

[45] Feb. 19, 1980

[54] SHEET TRANSFER AND STACKING APPARATUS

[75] Inventor: Stanley V. Ehrlich, Portland, Oreg.

[73] Assignee: Georgia-Pacific Corporation, Portland, Oreg.

[21] Appl. No.: 899,338

[22] Filed: Apr. 24, 1978

[51] Int. Cl.[2] ..... B65H 31/32; B65H 31/30

[52] U.S. Cl. ..... 414/45; 271/184; 271/189; 271/218; 414/50; 414/98

[58] Field of Search ..... 271/189, 218, 84, 184, 271/176, 225, 217, 219, 215, 159; 214/6 DK, 6 H; 198/457, 750; 414/45, 50, 98

[56] References Cited

U.S. PATENT DOCUMENTS

| | | | |
|---|---|---|---|
| 3,134,476 | 5/1964 | Pierson et al. | 198/457 X |
| 3,231,100 | 1/1966 | Faeber | 271/218 X |
| 3,446,368 | 5/1969 | Nelson | 214/6 DK |
| 3,489,263 | 1/1970 | Gentry | 198/774 |

*Primary Examiner*—Bruce H. Stoner, Jr.

[57] ABSTRACT

An apparatus is disclosed for transferring sheet material from a receiving station to a stacking station. A vertically reciprocative roll case is mounted to a stationary main frame by airsprings. Horizontally reciprocative transfer arms mounted on the main frame between the parallel rolls of the roll case, extend to transfer a sheet assembly to an adjacent stacking station when the roll case drops to a level below such arms. Stacking arms extending between but below the extended transfer arms are cantilevered from a vertically movable carriage on a support frame and receive the sheet assembly when the transfer arms retract. Accumulator arms parallel to and vertically aligned with the stacking arms are carried by a separate carriage movable vertically on the support frame. The stacking arms index downwardly a short distance upon receipt of each sheet assembly from the transfer arms. When the stacking arms have received a predetermined number of assemblies, they lower continuously to a level below a transfer conveyor to deposit the stack on such conveyor. As the stacking arms descend to the conveyor, the accumulator arms extend to receive additional sheet assemblies from the transfer arms. They also index downwardly upon the receipt of each sheet assembly. When the stacking arms are unloaded, they rise and relieve the accumulator arms of their load, whereupon the accumulator arms retract and rise to their upper limit position.

14 Claims, 16 Drawing Figures

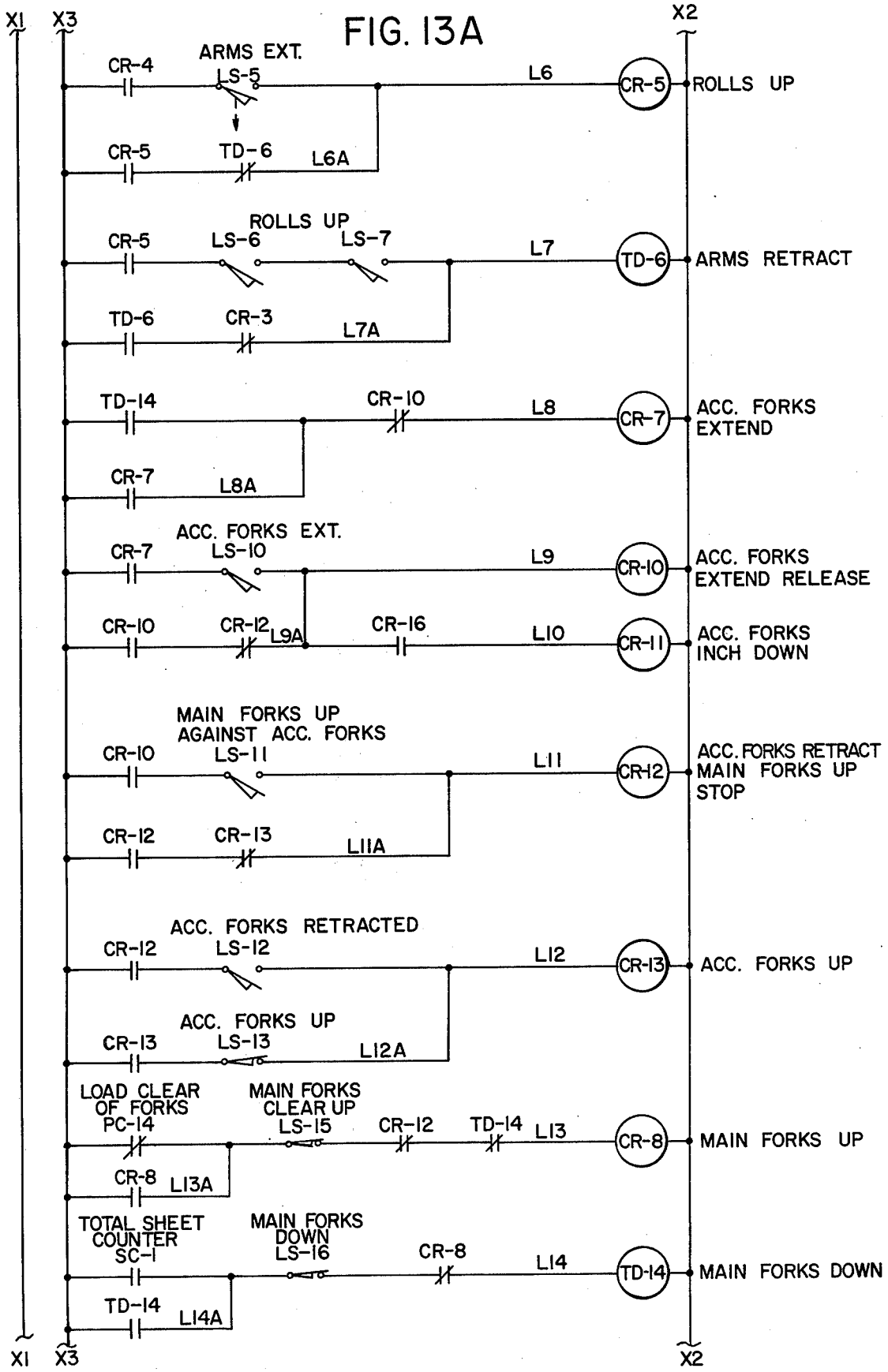
FIG. 13A
X1
X3
X2
CR-4
ARMS EXT.
LS-5
L6
CR-5
ROLLS UP
CR-5
TD-6
L6A
CR-5
ROLLS UP
LS-6
LS-7
L7
TD-6
ARMS RETRACT
TD-6
CR-3
L7A
TD-14
CR-10
L8
CR-7
ACC. FORKS EXTEND
CR-7
L8A
ACC. FORKS EXT.
CR-7
LS-10
L9
CR-10
ACC. FORKS EXTEND RELEASE
CR-10
CR-12
L9A
CR-16
L10
CR-11
ACC. FORKS INCH DOWN
MAIN FORKS UP AGAINST ACC. FORKS
CR-10
LS-11
L11
CR-12
ACC. FORKS RETRACT MAIN FORKS UP STOP
CR-12
CR-13
L11A
ACC. FORKS RETRACTED
CR-12
LS-12
L12
CR-13
ACC. FORKS UP
ACC. FORKS UP
CR-13
LS-13
L12A
LOAD CLEAR OF FORKS
PC-14
MAIN FORKS CLEAR UP
LS-15
CR-12
TD-14
L13
CR-8
MAIN FORKS UP
CR-8
L13A
TOTAL SHEET COUNTER
SC-1
MAIN FORKS DOWN
LS-16
CR-8
L14
TD-14
MAIN FORKS DOWN
TD-14
L14A
X1
X3
X2

SHEET TRANSFER AND STACKING APPARATUS

BACKGROUND OF THE INVENTION

1. Field of the Invention

The present invention relates to the transfer and stacking of sheet material and especially to the transfer of preglued loose assemblies of wood veneer to a stacking station and the stacking of such assemblies for pressing into plywood.

2. Description of the Prior Art

The closest known prior apparatus for transferring and stacking veneer sheet assemblies preparatory to pressing the assemblies into plywood sheets is shown in U.S. Pat. No. 3,446,368. Although such prior apparatus is capable of transferring and stacking sheet assemblies, it is a complex and costly machine. The arms for transferring the sheet material to the stacking apparatus undergo four separate rectilinear movements for which appropriate mechanism must be provided to accomplish, including (1) an elevating movement to lift sheet material from conveyor belts, (2) an extending movement to transfer sheet material to a stacking station, (3) a lowering movement while extended to position the sheet in closely overlying relationship to a load-receiving device of a stacking apparatus, and finally (4) a retracting movement to return the arms to their original positions below the level of the aforementioned conveyor belts.

In addition, such prior apparatus has an accumulator arm mechanism built into the same frame that supports the transfer arm and conveyor belt assembly, thereby further increasing the cost and complexity of the apparatus and decreasing its versatility. Because a single supporting frame is burdened with all of the aforementioned mechanisms, there is insufficient space to enable the passage of a stack of sheet assemblies in a direction beneath such frame on a suitable transfer conveyor. Therefore, a completed stack must be removed from the stacking station either in the opposite direction or in directions normal to the alignment of the conveyor and stacking frames, thereby eliminating a space-saving option in the layout of a plywood layup line for optimum space utilization within a plywood mill.

A further disadvantage of the prior mentioned apparatus is that because of its peculiarities of construction it cannot be readily converted from a right-hand side shift to a left-hand side shift machine, or vice versa, without extensive modification. This necessitates knowledge of how the machine will be used in a plywood mill, i.e. as a left-hand or right-hand shift machine, before the machine is built.

Accordingly, there is a need for an improved apparatus for transferring and stacking assemblies of veneer in the manufacture of plywood.

SUMMARY OF THE INVENTION

The present invention is an improved apparatus for transferring sheet assemblies to a stacking station and there stacking such assemblies. The apparatus of the present invention is thought to be an improvement over prior known apparatus having the same general objective in that the apparatus of the invention is considerably simplified and therefore less costly, more trouble-free and more versatile than prior known apparatus, these being the general objectives of the invention.

More specific objectives and features of the invention include:

(a) transfer arms which have a simple reciprocative movement rather than the more complex rectilinear movement of prior apparatus;

(b) the combination of horizontally reciprocative transfer arms and a vertically reciprocative conveyor assembly to eliminate the need for rectilinear transfer arm movement;

(c) the separation of the conveyor and transfer functions on one hand and the stacking and accumulator functions on the other hand on separate spaced frames on opposite sides of the stacking station for simplicity and for providing stack-conveying passages beneath both frames so that stacks of sheet assemblies can be transferred from the stacking station in either of opposite directions beneath either frame;

(d) the unique downwardly indexing cantilevered stacking arms for receiving sheet assemblies from the transfer arms and accumulating a stack of such assemblies and for depositing a stack of such assemblies on a transfer conveyor at the lower end of the stacking station;

(e) the unique mounting and coordination of stacking arms and accumulator arms on the same support frame but on separate vertically indexable carriages so that stacking can proceed without interruption on the accumulator arms while one stack is being unloaded by the stacking arms; and (f) the unique construction and nested relationship of stacking and accumulator arms for efficient trouble-free operation, high-speed stacking and optimum space utilization.

The foregoing and other objects, features and advantages of the present invention will become more apparent from the following detailed description which proceeds with reference to the accompanying drawings.

BRIEF DESCRIPTION OF DRAWINGS

In the drawings:

FIGS. 13, 13A and 13B are schematic diagrams of an electrical control circuit for controlling the operation of the invention.

DETAILED DESCRIPTION OF A PREFERRED EMBODIMENT

General Assembly

Figure 1:
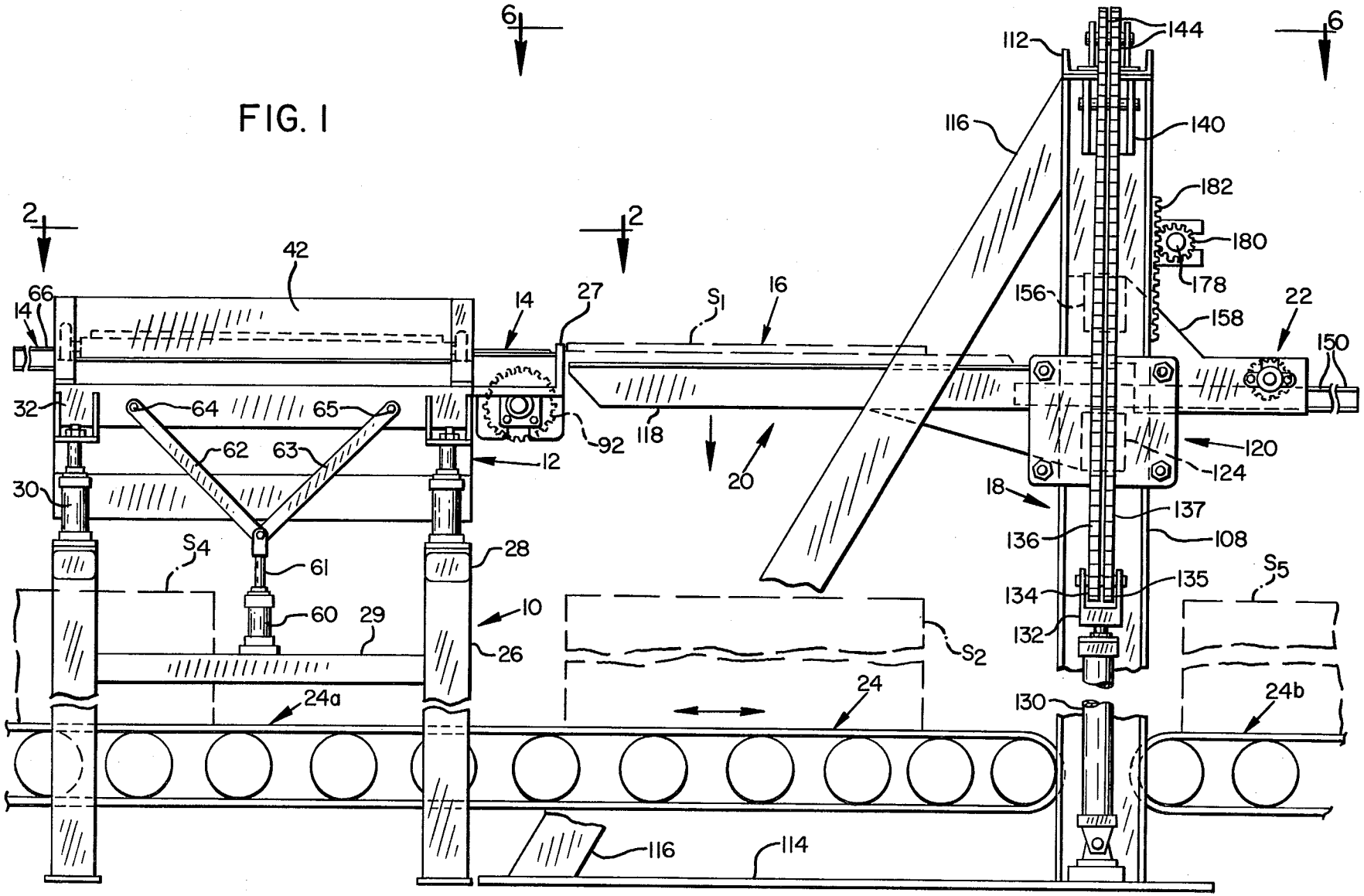
FIG. 1 is a vertically foreshortened side elevational view of the combined transfer and stacking apparatus of the invention.
Figure 1A:
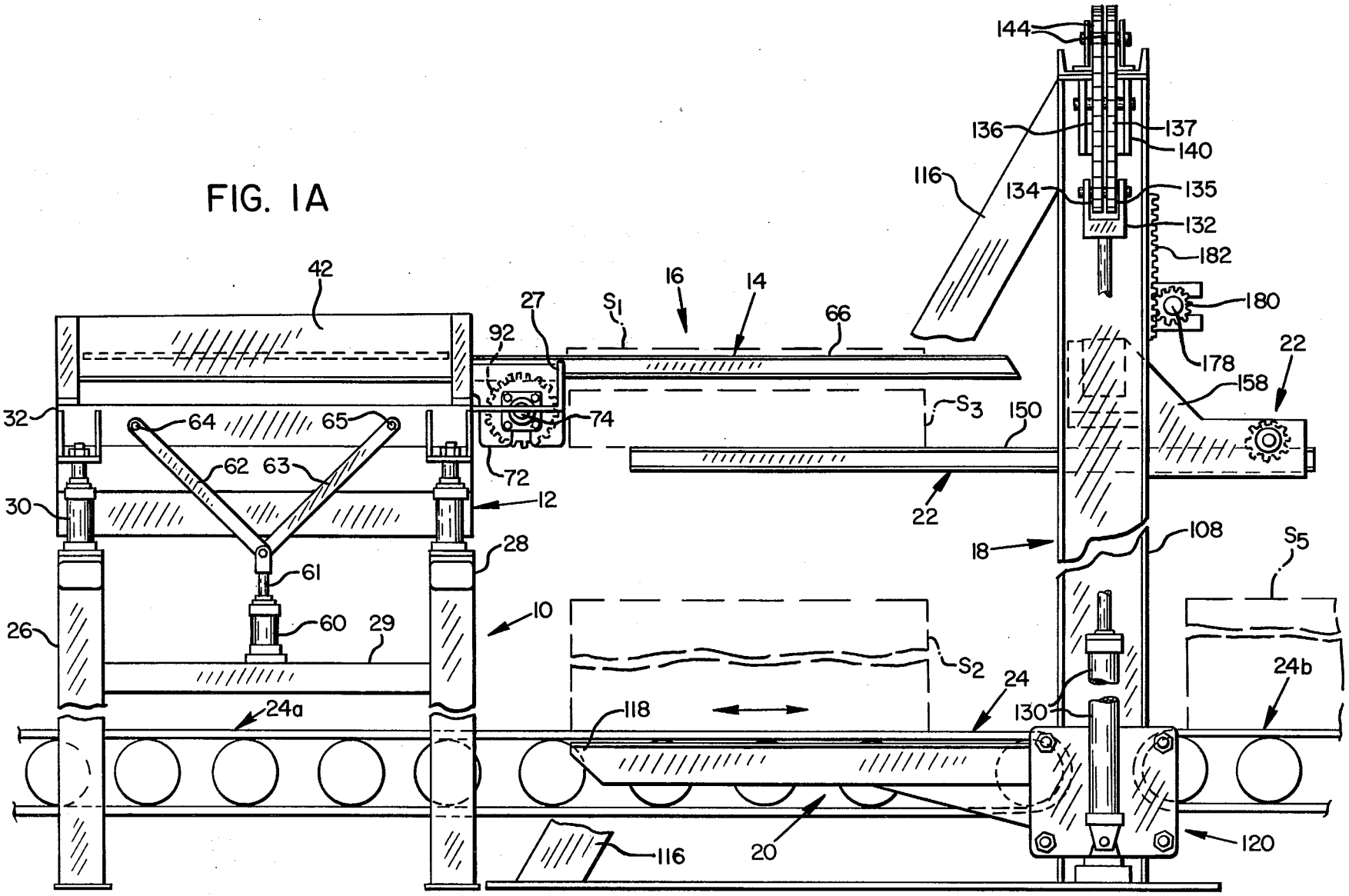
FIG. 1A is a view similar to that of FIG. 1, but showing the stacking arms of the apparatus in a lower limit position and the transfer arms and accumulator arms of the apparatus in their extended positions.
Figure 2:
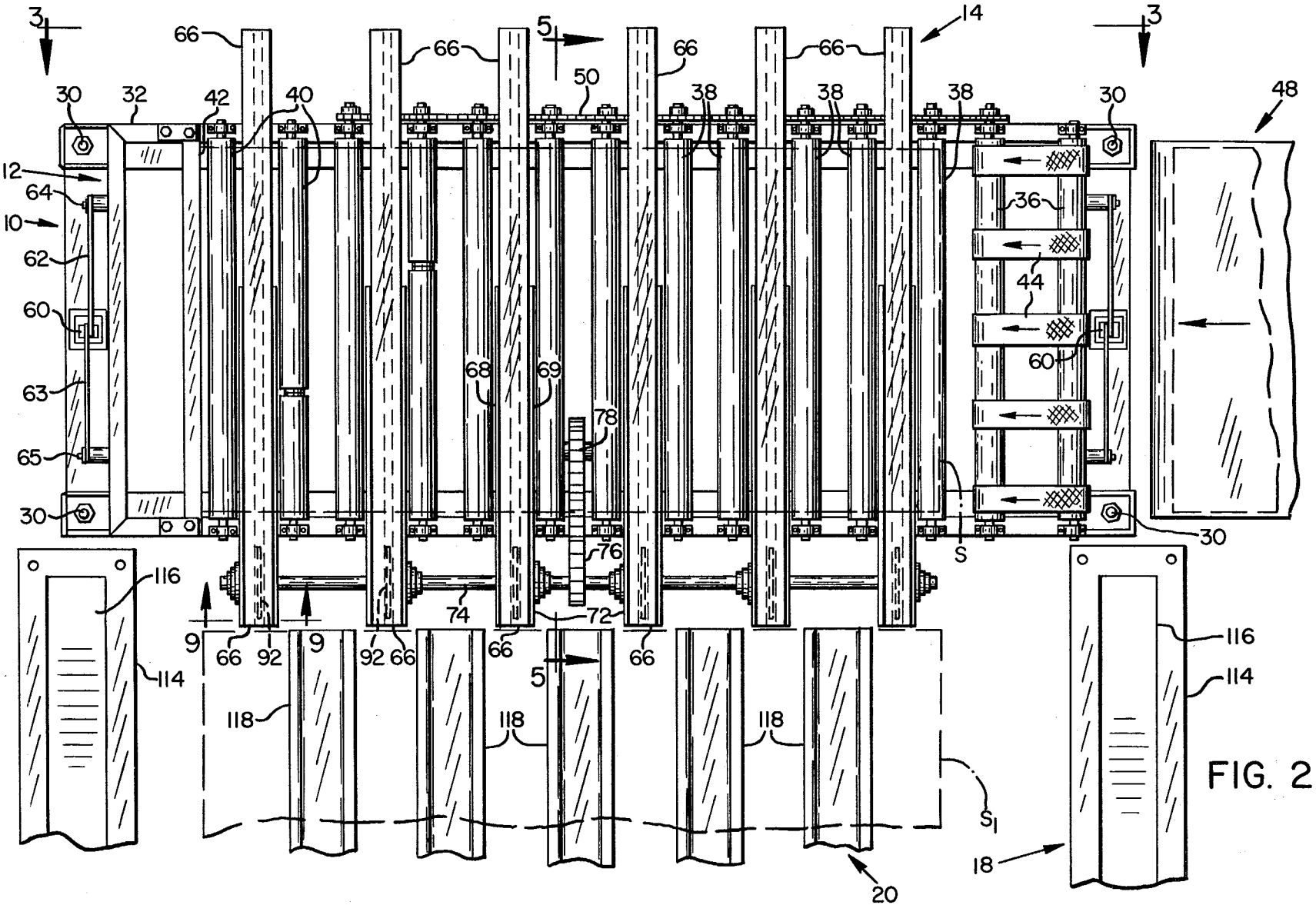
FIG. 2 is a top plan view of the conveyor and transfer arm assembly of the apparatus of FIG. 1 and outer end portions of the stacking arms of the apparatus as viewed from approximately the line 2—2 of FIG. 1.

Referring to the drawings, FIGS. 1, 1A and 2 disclose the overall transfer and stacking apparatus of the invention. The apparatus includes a stationary main frame 10 supporting a vertically reciprocative but horizontally stationary infeed conveyor case 12 for receiving loose assemblies of preglued veneer sheets from an upstream glue line of an automated plywood layup line. Main frame 10 also supports horizontally reciprocative but vertically stationary transfer arm means 14 between parallel conveyor elements of conveyor case 12. The transfer arm means extend from a retracted position between the rolls to an extended position, as shown in FIG. 1A, at a stacking station 16 to transfer sheet assemblies S-1 one at a time to such station.

A stacking support frame 18 is mounted at an opposite side of stacking station 16 from main frame 10. Support frame 18 supports stacking arm means 20 for vertical movement. Stacking arm means 20 is cantilevered horizontally from the support frame to the stacking station and toward transfer arm means 14 of main frame 10. The stacking arm means 20 indexes downwardly upon each delivery of sheet material to it by transfer arm means 14.

Support frame 18 also supports accumulator arm means 22. The accumulator means is horizontally reciprocative between a retracted position as shown in FIG. 1 and an extended position at the stacking station 16 as shown in FIG. 1A. In the latter position such arm means receives sheet material S-3 from transfer arm means 14 when stacking arm means 20 is lowered to an unloading position at the bottom of stacking station 16.

A transfer conveyor 24 extends along the bottom of stacking station 16 to receive a stack of sheets S-2 deposited thereon when stacking arm means 20 descends below such conveyor. The conveyor extends beneath main frame 26 at 24*a* and in the opposite direction beneath support frame 18 at 24*b*. Both such frames provide space therebeneath for the passage of a stack of sheet material on such conveyor after the stack is transferred from arm means 20 to the conveyor. The stack of sheet material S-2 on transfer conveyor 24 is shown at S-4 passing beneath the main frame 10 and at S-5 passing in the opposite direction beneath support frame 18, sufficient clearance being provided beneath both frames to provide the apparatus with this versatility.

Summary of Operation

Typically, the apparatus operates in a conveyor line such as in a plywood layup line just downstream of a so-called glue line where glue is applied to faces of veneer sheets and such sheets are assembled into uncompressed plywood assemblies of several ply thickness. One sheet assembly at a time is delivered onto roll case 12 with the conveyor case in a raised position so that the supporting surfaces of the conveyor elements are above the level of the support surfaces of transfer arm means 14. Then the roll case is dropped to a lowered position, transferring the sheet material to the support surfaces of the transfer arm means 14, whereupon the transfer arm means extend to side shift the sheet material to the stacking station 16 just above the level of stacking arm means 20. Then conveyor case 12 rises to its upper position and transfer arm means 14 retract, causing a stripper means 26 on the conveyor case to strip the sheet material from the transfer arms, leaving it at the stacking station supported on stacking arm means 20.

Stacking arm means 20 index down a distance of about one sheet assembly thickness in readiness to receive the next sheet assembly from transfer arm means 14. When a stack of sheet material is built to a predetermined height on stacking arm means 20, such arm means is lowered continuously to a position below the level of transfer conveyor 24, transferring the stack to such conveyor which then conveys the stack from the stacking station to the next station, such as a prepress, for further processing.

During the lowering of the stacking arm means to the transfer conveyor, accumulator arm means 22 extends to receive additional sheet material from transfer arm means 14 and index downwardly upon receipt of each sheet assembly, thereby building the small stack S-3 on such arm means. When stacking arm means 24 is unloaded and stack S-2 clears the stacking station, the stacking arm means rises to the level of the accumulator arm means and stops. The small stack S-3 on the accumulator arms is transferred to the stacking arm means because at this common position of the stacking and accumulator arms, the upper surfaces of the stacking arms are slightly above the upper surface of the accumulator arms. When the accumulator arm means is thus relieved of its load, it retracts and returns to its upper limit position as shown in FIG. 1, while stacking continues as before on the stacking arms.

From the foregoing it will be apparent that main frame 10 mounts a sheet infeed conveyor and transfer assembly whereas support frame 18 mounts stacking and accumulator arm assemblies.

Conveyor and Transfer Assembly

Main frame 10 is constructed so that it straddles transfer conveyor 24 and includes upright support means comprising four support legs 26 which stand astride opposite sides of the transfer conveyor. The legs on opposite sides of such conveyor are interconnected by high cross frame members 28 which bridge the conveyor 24 to provide clearance beneath the frame, and the legs on the same side of the conveyor are interconnected by low cross frame members 29. High cross frame members 28 are at a sufficient elevation above transfer conveyor 24 such that stacks of sheet material can pass freely under the main frame on such conveyor.

Figure 3:
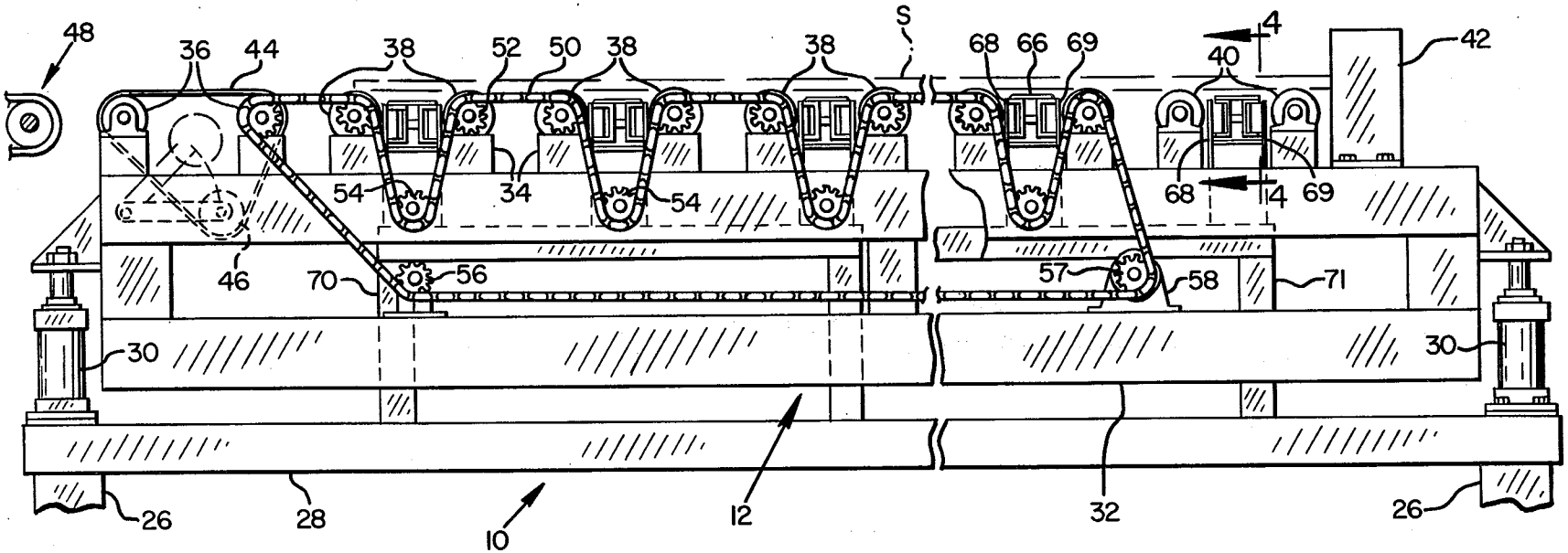
FIG. 3 is an elevational view of the conveyor and transfer arm assembly portion of the apparatus of FIG. 1 as viewed from approximately the line 3—3 of FIG. 2.

As shown best in FIGS. 1 and 3, conveyor case 12 is a generally rectangular roll case which is mounted for vertical reciprocation above cross frame members 28 by mounting means comprising air springs 30 at the four corners of the roll case. The air springs bias the case to a raised position as shown in FIGS. 1 and 3. Roll case 12 includes a box-like frame 32. Box frame 32 has a series of spaced roll mounting blocks 34 mounted in pairs along opposite upper edges of such frame. The blocks mount a series of parallel conveyor rolls, including a pair of belt rolls 36 at the infeed end of the roll case, several driven rolls 38 spaced throughout the intermediate portion of the roll case, and idler rolls 40 adjacent to an infeed stop member 42 at the downstream end of the roll case.

Drive belts 44 are trained about the two belt rolls 36 and a third tension roll 46 at the infeed end of the roll case to form a bridging infeed belt conveyor which transfers sheet material from an upstream conveyor indicated generally at 48 to driven rolls 38 of the roll case. Driven rolls 38 are driven through an endless drive chain 50 engaging driven sprockets 52 on shaft extensions of live rolls 38 and one belt roll 36, idler sprockets at 54, 56 and a driven sprocket 57 on the drive shaft of a drive motor 58. The motor and described drive train are carried by the box frame of the roll case 12 as shown in FIG. 3.

Referring to FIGS. 1 and 1A, a single-acting fluid-actuated cylinder 60 is mounted at each of the opposite ends of main frame 10 on cross frame members 29. The upwardly extending piston rod 61 of each cylinder is connected by links 62, 63 to box frame 32 of the roll case at pivot connections 64, 65. The total downward force developed by the pair of cylinders 60 is sufficient to overcome the total upwardly biasing force of the four air springs 30. Thus upon retraction of piston rods 61 of cylinders 60, roll case 12 is dropped from its raised position shown in FIG. 1 to its lowered position shown in FIG. 1A. However, upon relief of retracting fluid pressure in cylinders 60, air springs 30 quickly return the roll case to its raised position. Cylinders 60 and air springs 30 therefore serve as means for reciprocating roll case 12 vertically between its normal "up" position and a temporary "down" position for transferring sheet material from the conveyor rolls to the transfer arm means.

Figure 5:
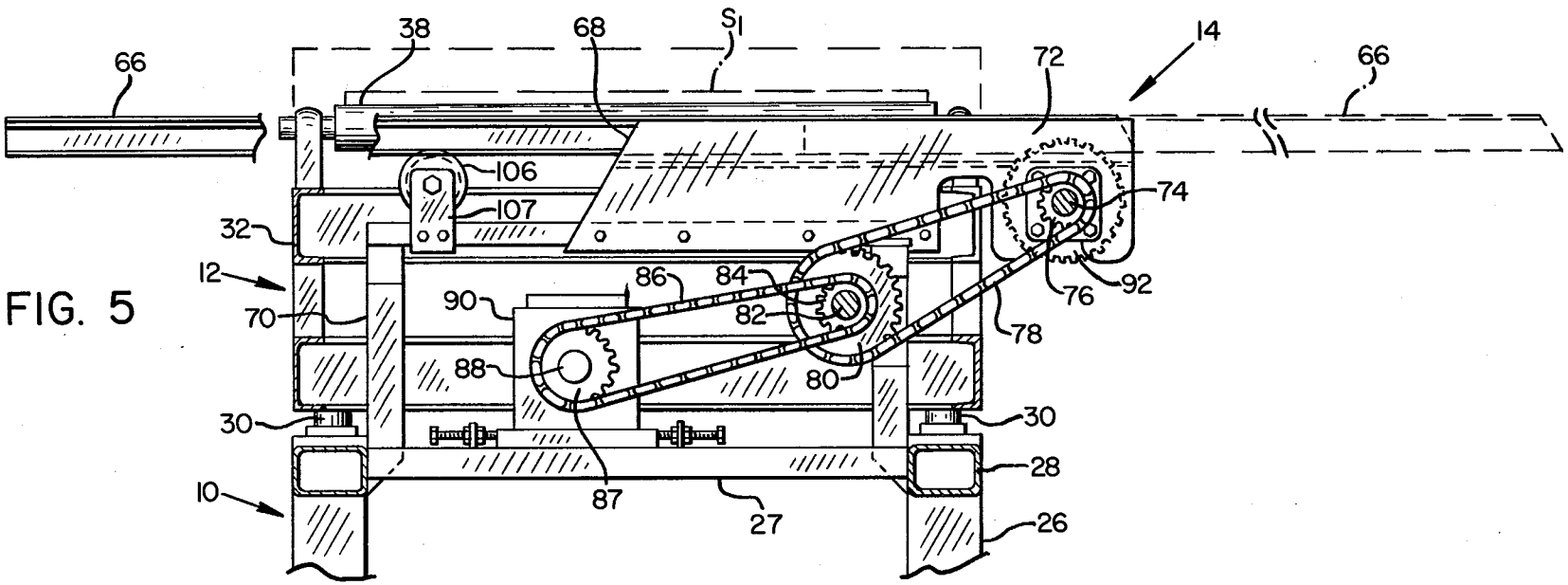
FIG. 5 is a vertical sectional view taken along the line 5—5 of FIG. 2 showing the mounting and drive mechanism for reciprocating the transfer arms.

The transfer arm means includes multiple parallel transfer arms 66 and transfer arm-mounting means mounting each arm for horizontal reciprocation. Such mounting means includes a pair of side plates 68, 69 mounting each arm longitudinally between a pair of rolls 38, 40 of the roll case, as shown best in FIGS. 2 and 3. Each pair of side plates is mounted to stationary main frame 10, more specifically to frame risers 70, 71 shown in FIGS. 3 and 5. As shown in FIG. 5 with respect to side plate 68, each pair of side plates includes forward extensions 72 which project beyond one side of box frame 32 of the roll case toward the stacking station and rotatably mount a long shaft 74.

Shaft 74 extends through all pairs of side plate extensions, as shown best in FIG. 2. Midway along its length, shaft 74 carries a sprocket 76 (FIG. 5) about which an endless drive chain 78 is trained. Such chain is also trained about a larger sprocket 80 on a jack shaft 82 carried by frame riser 70. Such jack shaft also carries a smaller sprocket 84 about which a second endless drive chain 86 is trained. Chain 86 is also trained about a drive sprocket 87 on the drive shaft 88 of a reversible hydraulic motor 90. The foregoing described motor, chain and sprocket drive serves as a portion of a reversible drive means for rotating and counter-rotating long shaft 74 and thereby reciprocating the transfer arms 66. The remainder of such drive means includes a series of sprockets 92, one mounted in alignment beneath each transfer arm 66 on shaft 74 in engagement with a roller chain rack 104 (FIG. 4) carried by an underportion of each transfer arm 66.

Figure 4:
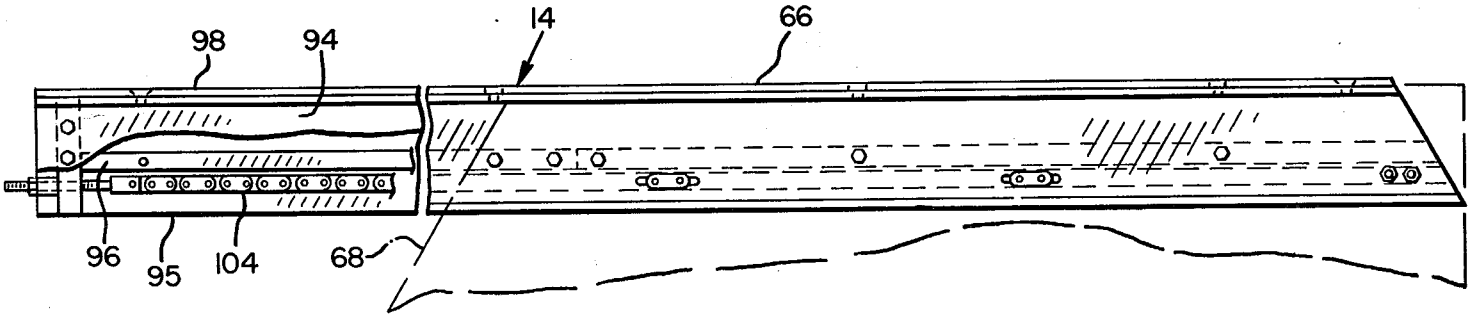
FIG. 4 is a horizontally foreshortened side elevational view of one transfer arm of the apparatus as viewed from approximately the line 4—4 of FIG. 3, with a portion of the transfer arm broken away for clarity.
Figure 9:
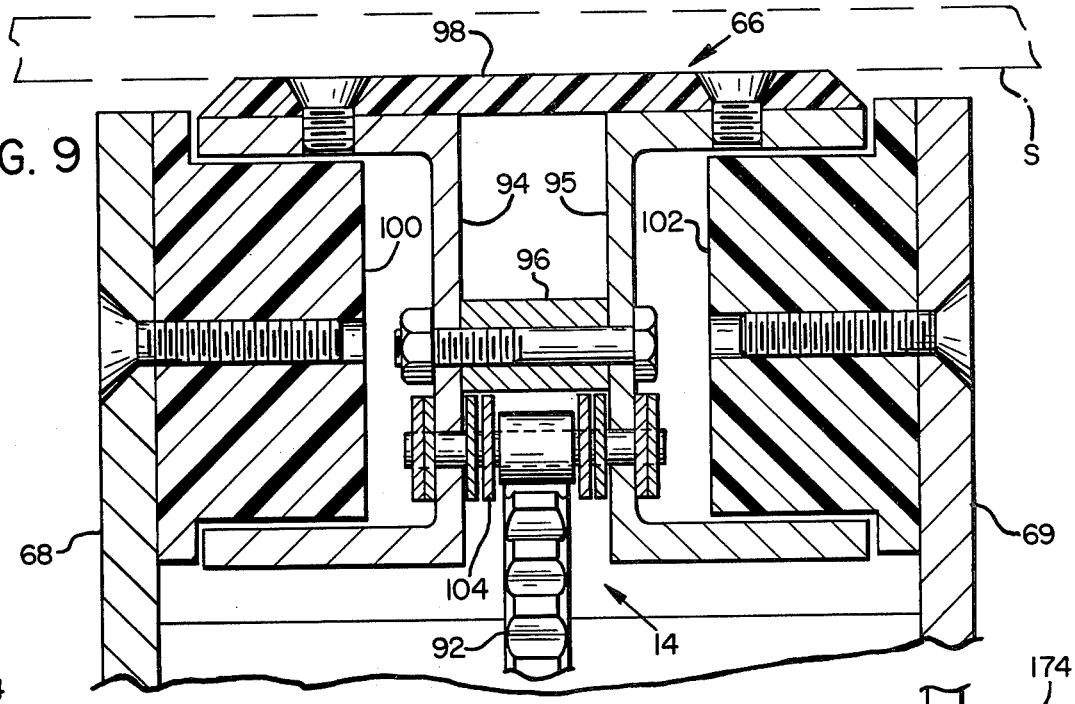
FIG. 9 is a vertical sectional view taken along the line 9—9 of FIG. 2 showing a cross section of a transfer arm.

The details of the transfer arm construction and drive arrangement are shown best in FIGS. 4 and 9. Each transfer arm includes a pair of channel members 94, 95 arranged back-to-back and connected together at intervals along their lengths by spacer members 96 so that a space is provided between the channel members. The top flanges of the two channel members are interconnected by a top plate 98, preferably made of a low-friction synthetic material commonly referred to in the trade as UMHW (ultra-high molecular weight) plastic. Each arm is slidably mounted on guide means comprising elongated guide members 100, 102 attached to inside surfaces of side plates 68, 69 and extending into the spaces between the upper and lower flanges of channel members 94, 95 so that the upper flange of each channel rides on an upper surface of each guide member 100, 102. Preferably the guide members, as top plate 98, are made of a low-friction material such as the aforementioned UMHW plastic.

A length of roller chain 104 extends along the length of each transfer arm in the space between the two channel members below spacers 96 and are connected to the two channel members in the manner shown in FIG. 9. Each drive sprocket 92 on shaft 74 is in driving engagement with a corresponding roller chain rack 104 in the manner shown.

Referring again to FIG. 5, each transfer arm 66 is supported near its rear end by guide rolls 106 carried by brackets 107 attached to frame risers 70, 71. Each transfer arm 66 is well supported throughout a substantial portion of its length when it is in either a retracted position as shown in FIGS. 1 and 5 or in an extended, cantilevered position as shown in FIG. 1A and in phantom lines in FIG. 5.

The transfer arms 66 and rolls 38, 40 of the roll case are so positioned that the sheet-supporting top surfaces of the rolls are at a level above the level of the sheet-supporting upper surfaces of the transfer arms 66 when the roll case is in its raised position as shown in FIGS. 1 and 5. However, when the roll case is lowered as shown in FIG. 1A, the tops of the rolls are below the upper surfaces of the transfer arms so that sheet material on the rolls is transferred to the arms and then delivered to the stacking station on the arms when they extend.

Stacking Assembly

Referring especially to FIGS. 1, 1A, 6 and 7, support frame 18 includes a pair of upright support means comprising I-beam support columns 108, 110 straddling opposite sides of transfer conveyor 24 and interconnected at their upper ends by a bridging frame member 112. The two support columns rest on identical base members 114 which may be said to define approximately the laterally outer limits of the stacking station 16. Diagonal bracing members 116 connect the upper ends of columns 108, 110 to the forward ends of base members 114 to rigidify the support frame.

Figure 6:
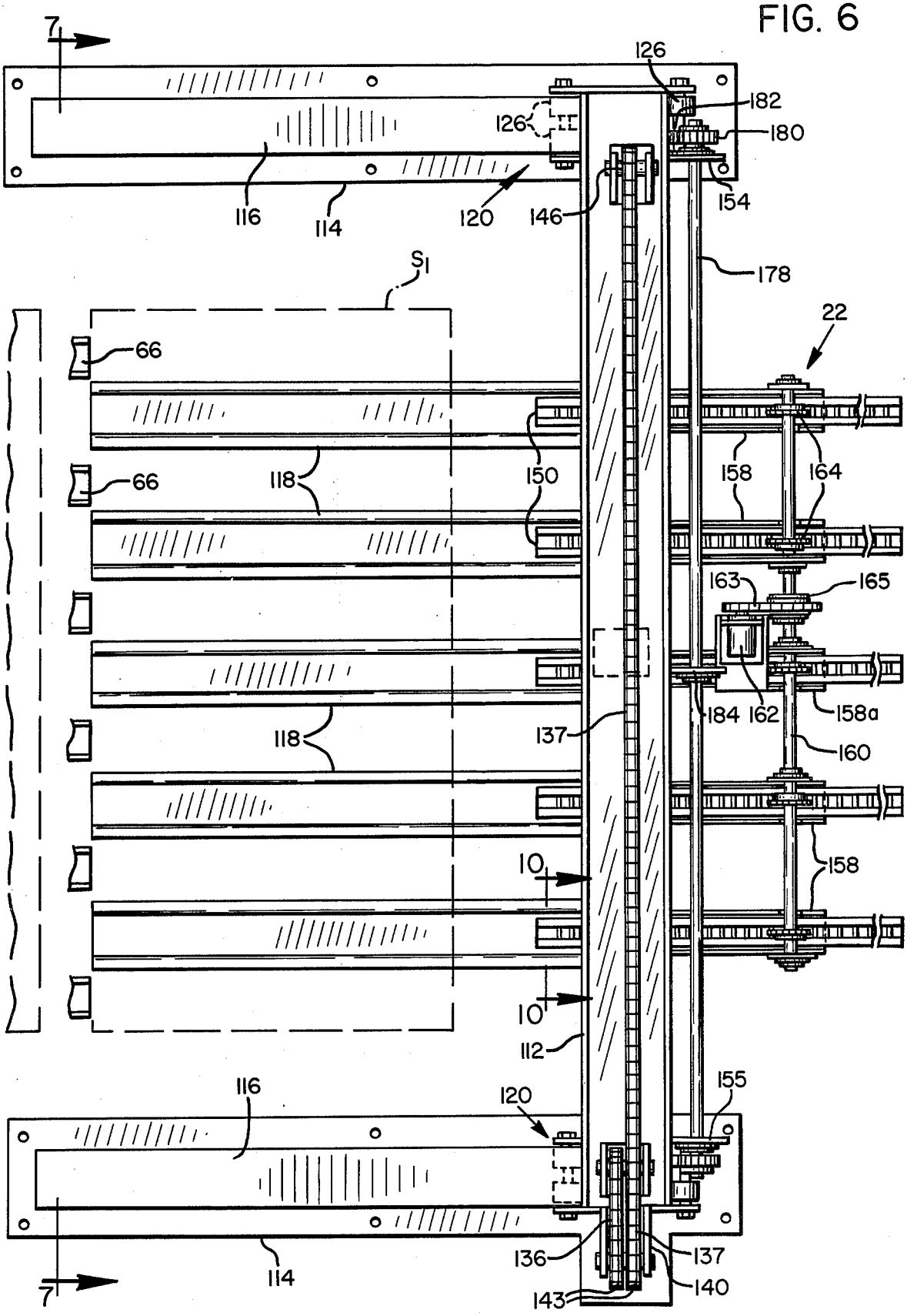
FIG. 6 is a top plan view of the stacking and accumulator arm assembly portion of the apparatus as viewed from approximately the line 6—6 of FIG. 1 with the accumulator arms foreshortened.

The stacking arm means 20 comprises a stacking arm assembly which includes multiple horizontally extending parallel stacking arms 118 cantilevered toward main frame 10 from a first, stacking arm carriage 120 movable vertically along support columns 108, 110. Stacking arm carriage 120 includes a pair of carriage end members 122, 123, one in rolling engagement with the flanges of each support column 108, 110, and a stacking arm support beam 124 extending between the columns and connected at its opposite ends to carriage end members 122, 123. Pairs of rollers 126 in rolling engagement with each flange face of the columns and rotatably supported on shafts 127 interconnecting carriage side plates 128, 129 enable the carriage end members to roll freely along columns 108, 110. The cantilevered stacking arms 118 are mounted at their inner ends to the top surface of carriage beam 124 in equally spaced-apart relationship. As shown in FIG. 6, each stacking arm is aligned with a space between each transfer arm 66 so that the transfer arms can be extended into the stacking station without conflict with the stacking arms.

Means are provided for lowering and raising the stacking arm carriage along the support beams 108, 110 and more specifically for indexing the stacking arms downwardly from their raised positions as a stack builds up on them. Such stacking arm carriage drive and indexing means includes a vertically disposed long-stroke fluid-operated extensible cylinder 130 mounted to base plate 114 alongside support column 108. A clevis 132 mounted to the outer end of the piston rod of cylinder 130 carries a shaft 133 which supports a pair of sprockets 134, 135 over which lengths of two separate roller chains 136, 137 are trained. One end of each chain is anchored by take-up means 138 to an upper end portion of support column 108 by a bracket member 140. The opposite end of chain 136 is anchored to carriage end member 123 as shown at approximately 142 in FIG. 7 after passing under a cylinder sprocket 134, over a sprocket 143 on bracket 140 and over one of a pair of sprockets 144 above column 108 on bridging member 112.

The other chain length 137 proceeds in the same general path as chain 136 from its anchor at bracket 140 until it reaches the pair of sprockets 144 on bridging member 112. From there chain 137 proceeds from one side of the support frame along bridging member 112 to a sprocket 146 at its opposite side, and then downwardly along support column 110 to a connection with the opposite carriage end member 122. The chain lengths are adjusted so that the carriage end members 122 and 123 are maintained at corresponding levels on the opposite columns 108, 110, thereby maintaining carriage beam 124 and stacking arms 118 in horizontal planes.

Figure 7:
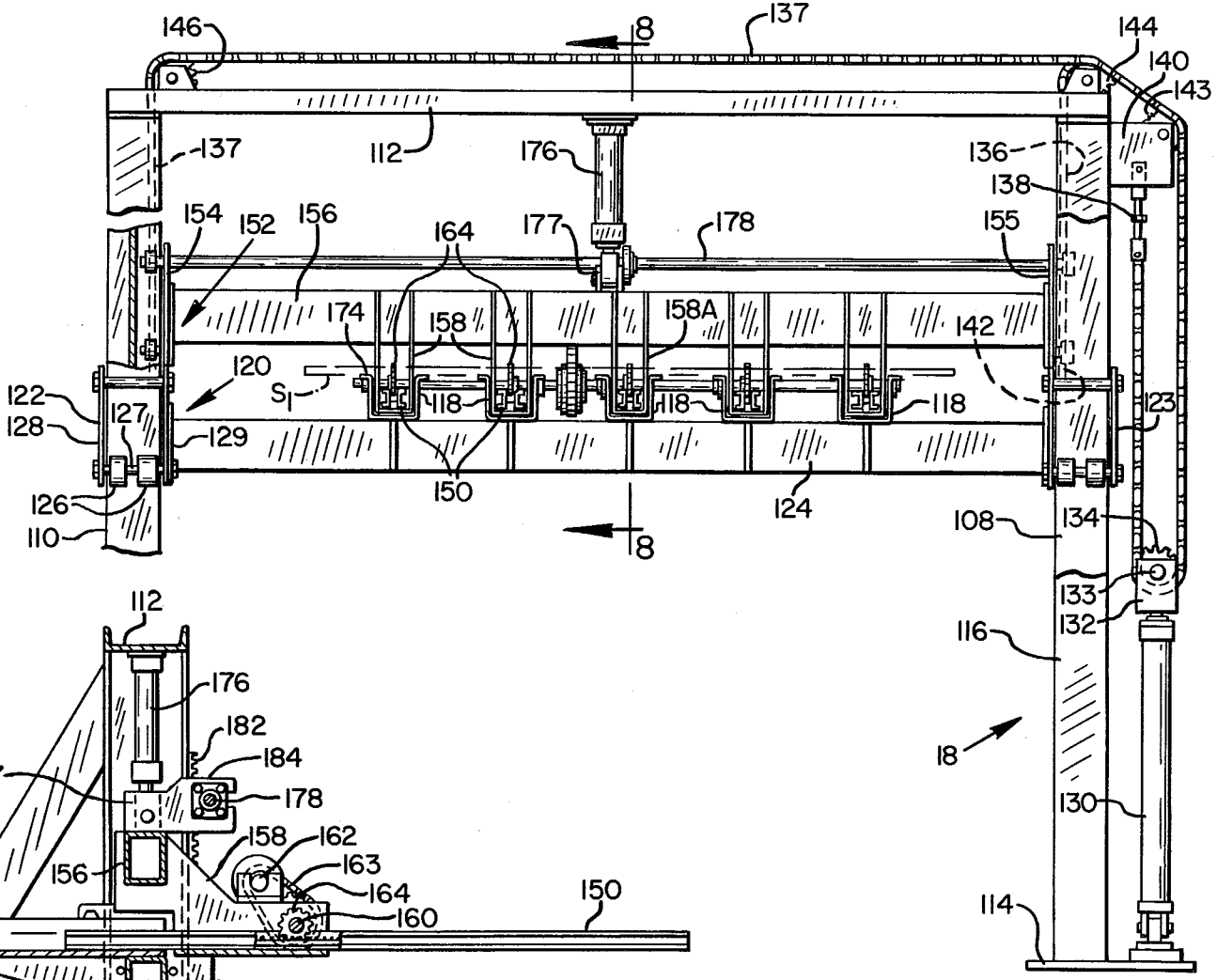
FIG. 7 is a partial and vertically foreshortened front elevational view of the stacking and accumulator assembly as viewed from approximately the line 7—7 of FIG. 6.

From FIG. 7 it will be apparent that as cylinder 130 extends in increments from its retracted position shown, the stacking arm carriage 120 and thus stacking arms 118 index downwardly from their raised positions shown. It will also be apparent that when cylinder 130 is extended to its maximum, stacking arm carriage 120, and thus the stacking arms, are lowered to a lower limit position in which the support surfaces of stacking arms 118 lie at a level below the support surfaces of transfer conveyor 24. In this regard, transfer conveyor 24 is advantageously of the belt or chain conveyor type with the belt or chain runs arranged so that the stacking arms 118 descend into the spaces between such belt or chain runs to a level therebelow, as shown in FIG. 1A.

Accumulator Arm Assembly

The accumulator arm means 22 comprises an accumulator assembly including multiple horizontal accumulator arms 150 corresponding in number to the stacking arms 118 and vertically aligned with such stacking arms. Accumulator arms 150 are mounted for horizontal reciprocation on a second carriage structure on support frame 18, referred to as the accumulator arm carriage and indicated generally at 152. The accumulator arm carriage includes carriage end members 154, 155 which are in rolling engagement with support columns 108, 110 for vertical movement along such columns. End members 154, 155 are connected to the opposite ends of a carriage beam 156 which extends horizontally between columns 108, 110 above carriage beam 124. Carriage beam 156 supports accumulator arms 150 by arm-mounting hangers 158 suspended therefrom. Beam 156 bridges transfer conveyor 24 at a height above such conveyor sufficient to provide clearance for a stack moving beneath the support frame on such conveyor, even with the beam in its lowermost indexed position.

Figure 10:
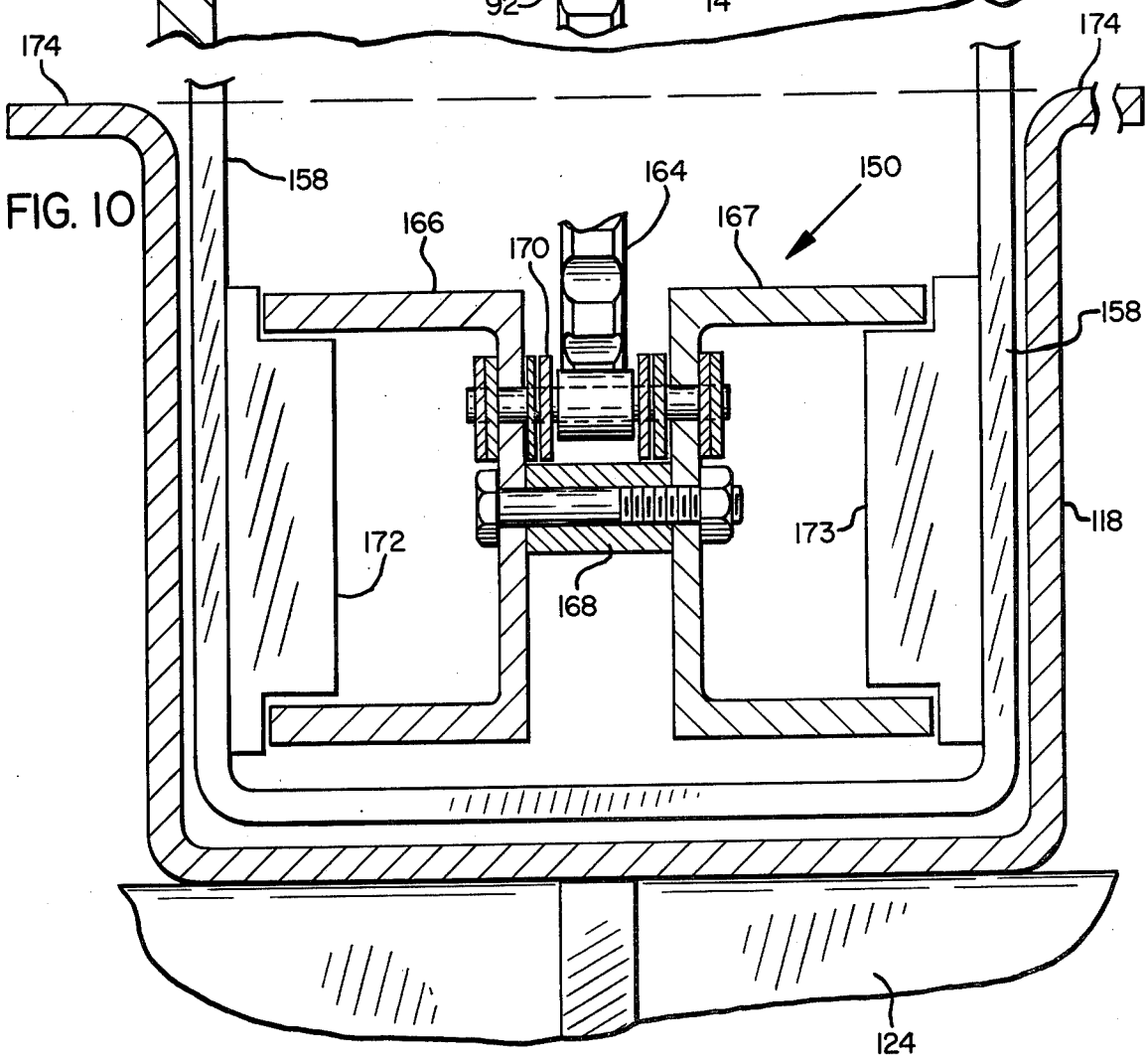
FIG. 10 is a sectional view taken along the line 10—10 of FIG. 6 showing a cross section through a stacking arm and nested accumulator arm.

As shown in FIGS. 7 and 10, each hanger 158 is of generally U-shaped cross section and mounts an accumulator arm 150 for sliding reciprocation therein. Hangers 158 also rotatably mount a long drive shaft 160 as shown best in FIGS. 6 and 8. The central hanger **158*a* of the five shown also carries a reversible hydraulic motor 162 connected by a belt or chain and sprocket drive 163 to shaft 160 through a clutch 165 for rotating shaft 160 in opposite directions. Shaft 160 carries a series of accumulator arm drive sprockets 164, each centered over a different one of the accumulator arms 150 and in driving engagement with a roller chain rack 170 (FIG. 10) on the arm so that rotation of shaft 160 in opposite directions reciprocates the accumulator arms between their extended and retracted positions. Such arms are shown in their retracted positions in FIGS. 6 and 8 and in their extended positions in FIG. 1A**.

Referring to FIG. 10, the details of construction of each accumulator arm and its mount are shown. Each arm 150 is composed of a pair of channel members 166, 167 arranged in back-to-back relationship and connected together by a spacer member 168 to provide a central space therebetween. The roller chain rack 170 for each arm extends along the length of the arm above spacer member 168 and is connected to opposed channel members 166, 167 at intervals along its length. Drive sprocket 164 is in driving engagement with roller chain 170 from above.

Each accumulator arm 150 is mounted for sliding reciprocation in its hanger member 158 on pairs of opposed elongated guide members 172, 173. The guide members are attached to the inside faces of the opposite sides of hanger 158 and extend inwardly therefrom into the space between the upper and lower flanges of channel members 166, 167. The upper flanges of channels 166, 167 ride on guide members 172, 173 in their sliding movement. The guide members are therefore preferably made of a low-friction material such as the previously mentioned UMHW plastic.

Figure 8:
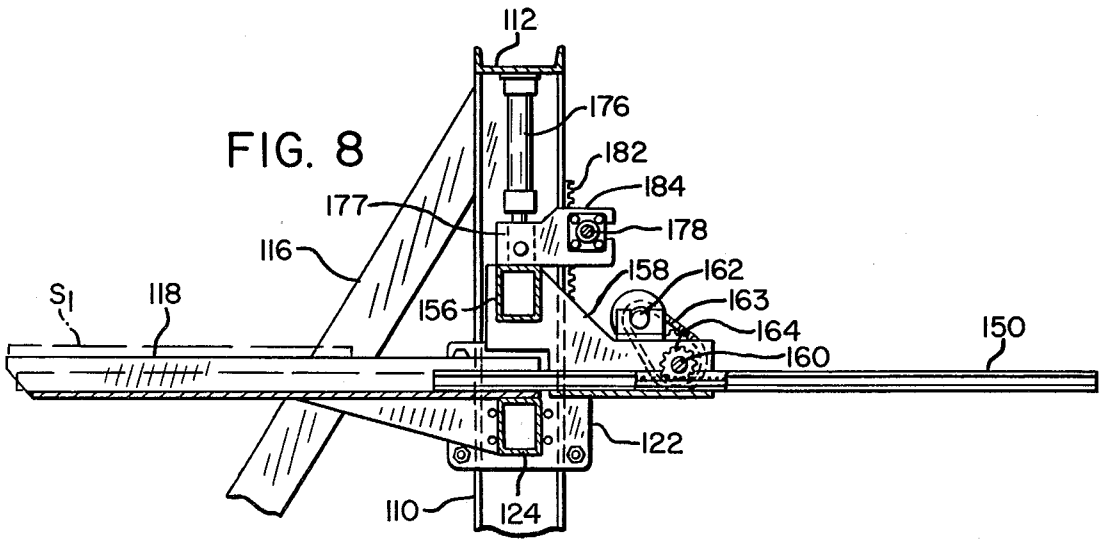
FIG. 8 is a vertical sectional view taken approximately along the line 8—8 of FIG. 7 showing the drive means for reciprocating and indexing the accumulator arms.

From FIGS. 7 and 8, it will be apparent that each accumulator arm 150 is aligned vertically and horizontally with a corresponding stacking arm 118. When the accumulator and stacking arms are in their upper limit positions, as shown in FIGS. 6–8, the leading portions of the accumulator arms extend into and nest within the corresponding stacking arms. They also have a nested relationship when the accumulator arms are extended and the stacking arms are raised to the level of the accumulator arms to relieve the latter arms of their load. In either case, the upper sheet-supporting surfaces of the stacking arms lie above the corresponding surfaces of the accumulator arms as shown in FIGS. 7 and 10.

As shown in FIGS. 7 and 10, stacking arms 118 are each of upwardly opening, generally U-shaped cross section with outwardly flanged upper edges 174 providing their sheet-supporting surfaces. This feature and the relatively larger size of the stacking arms enables the stacking arms, after depositing a load on the transfer conveyor, to move upwardly beneath the extended accumulator arms to the level of the latter arms and relieve the latter arms of their load as they become nested within the stacking arms. Thereafter the accumulator arms can retract and return to their raised positions while the stacking arms resume their stacking function, indexing downwardly upon receipt of each new sheet assembly from the transfer arms.

Indexing means are provided for indexing the extended accumulator arms downwardy upon receipt of each sheet assembly from the transfer arms, and for returning the accumulator arms to a raised position when their accumulating function has ended during a given unloading cycle. The accumulator indexing means includes a fluid-operated indexing cylinder 176 suspended from the underside of bridge member 112 of the support frame. Cylinder 176 has a downwardly extending piston rod connected at its lower end to a clevis 177 of the accumulator carriage beam 156. To help stabilize the accumulator carriage beam 156 and maintain its horizontal disposition, accumulator carriage opposite end members 154, 155 journal a long shaft 178, the opposite ends of which carry a pinion gear 180. Pinion gears 180 engage racks 182 on the rear faces of columns 108, 110. Thus when the indexing cylinder 176 indexes downwardly, the pairs of racks and pinions 182, 180 ensure that both ends of the accumulator carriage will move to the same extent, thereby maintaining the accumulator carriage beam and their connected arms in a horizontal attitude. As shown in FIGS. 6 and 7, the long pinion shaft 178 is actually coupled near its midpoint to the accumulator carriage beam 156 by a plate 184 for stability. Such plate forms a rearward extension of clevis 177 by which accumulator indexing cylinder 176 is attached to carriage beam 156.

Control and Operation

Figure 13:
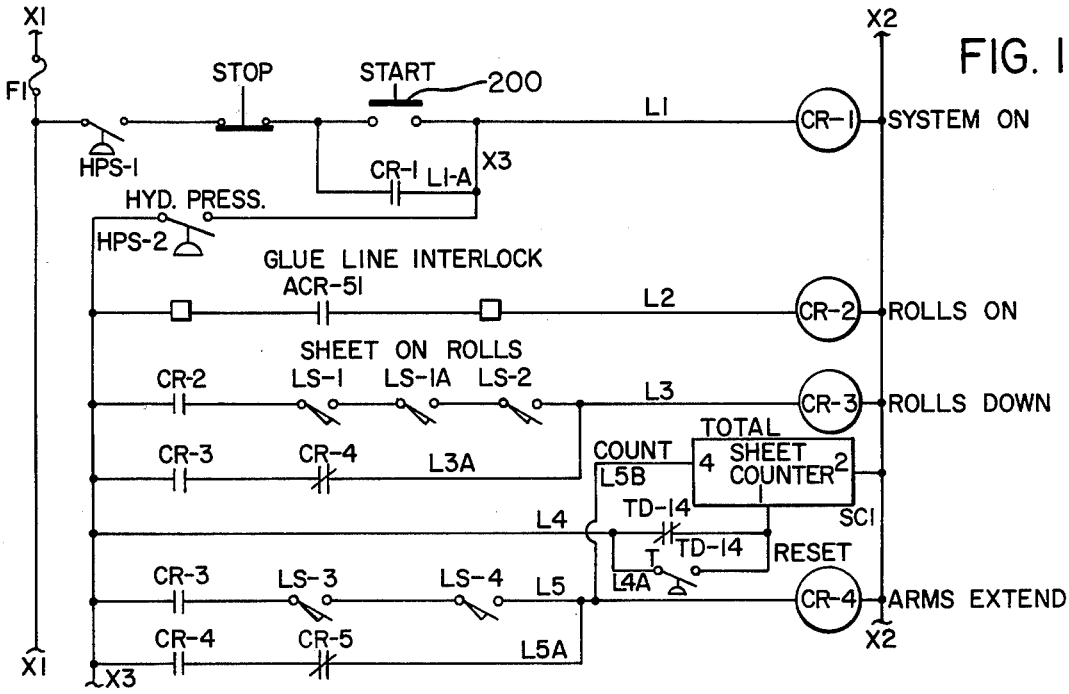
Figure 13B:
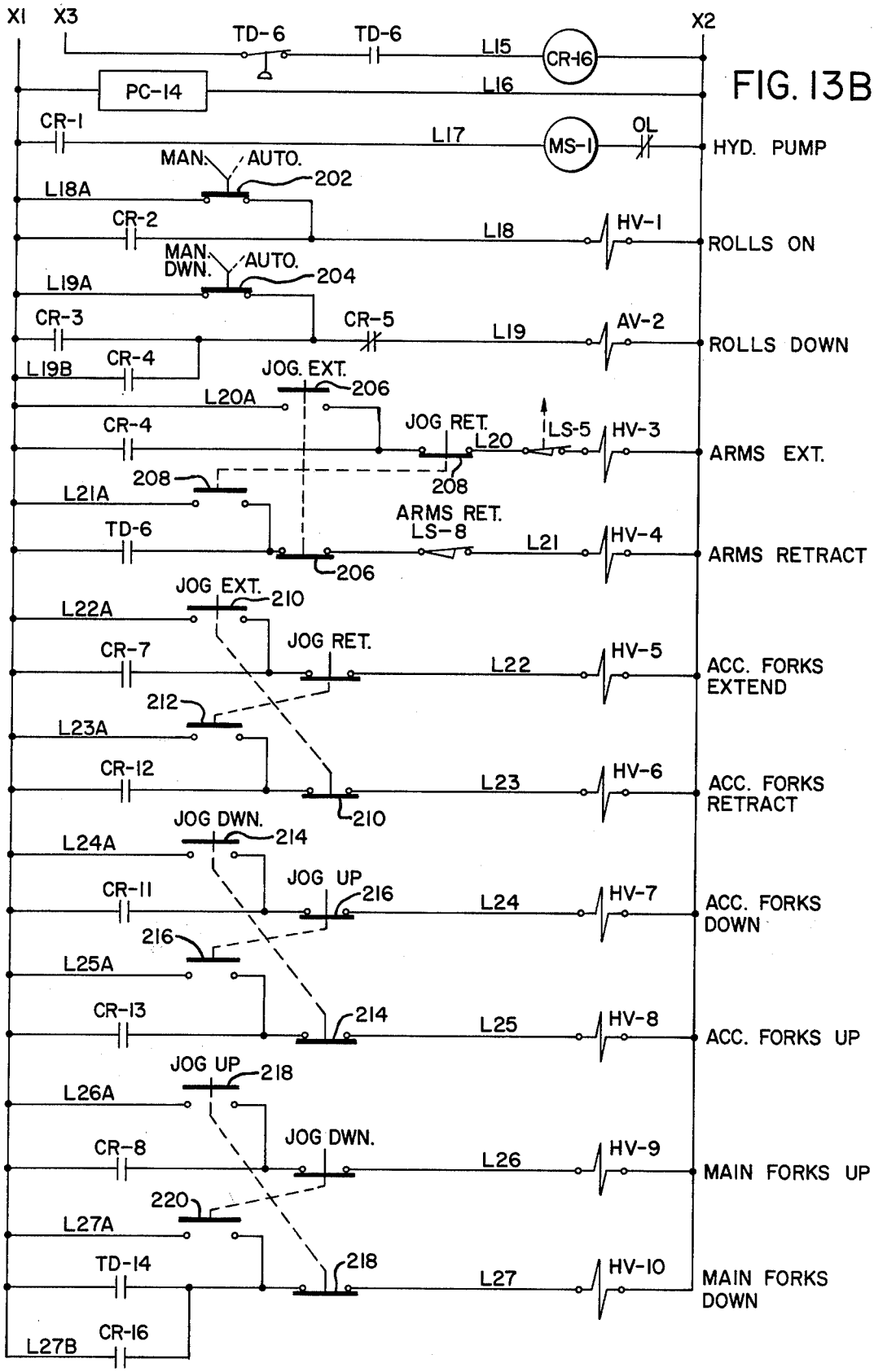

Referring now to the electrical control diagram of FIGS. 13–13B, operation of the machine is commenced by depressing a start switch 200 in line L-1 to energize relay CR-1. Relay CR-1 closes relay contact CR-1 in line L-1A to maintain relay CR-1 energized when start switch 200 is released. The energizing of relay CR-1 also closes the CR-1 contact in line L-17 to energize relay MS-1 to start a motor (not shown) which drives a system hydraulic pump.

When the pump starts, a build-up of system hydraulic pressure closes a hydraulic pressure-operated switch HPS-2 in line X-3, thereby energizing the electrical control system. More specifically, a relay CR-2 in line L-2 is energized because a contact ACR-51 in line L-2 has been closed through an interlock with the upstream glue line. With relay CR-2 energized, relay contacts CR-2 in lines L-3 and L-18 are closed to complete a circuit through line L-18, thereby energizing a hydraulic valve solenoid HV-1 to operate the hydraulic motor 58 (FIG. 3) to drive rolls 36, 38 of roll case 12 continuously.

Figure 11:
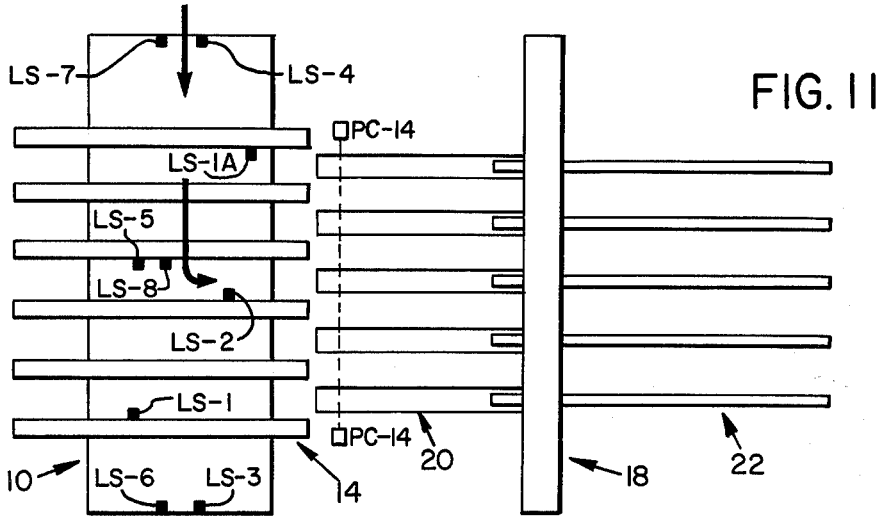
FIGS. 11 and 12 are schematic plan and elevational views of the apparatus, respectively, showing the location of limit switches thereon.

With the roll case in its normally air-spring-biased "up" position, a sheet assembly S proceeds onto the rolls, typically from the glue line, closing in sequence limit switches LS-1A, LS-2 and LS-1 in line L-3. These three limit switches are positioned on the main frame as shown in FIG. 11 and have actuators (not shown) extending above the upper level of the rolls so as to be contacted by the sheet assembly. The closing of these three limit switches energizes relay CR-3, closing relay contacts CR-3 in holding-in line L-3A and also in lines L-5 and L-19, the latter energizing an air valve solenoid AV-2, causing air cylinders 60 (FIGS. 1–2) to drop the roll case to its "down" position, thereby transferring the assembly S to transfer arms 66.

With the roll case down, limit switches LS-3 and LS-4 on the main frame and in line L-5 close, energizing a relay CR-4 and closing relay contacts CR-4 in holding-in line L-5A, line L-6, line 19-B and line L-20. The latter contact closes a circuit through line L-20, thereby energizing a hydraulic valve solenoid HV-3 to operate hydraulic motor 90 (FIG. 5) in a direction to extend transfer arms 66 with the sheet assembly S-1 on them, thereby transferring the assembly to stacking station 16 (see FIG. 1A).

When the roll case drops to its down position, it also completes a circuit through line L-5B, actuating a sheet counter SC-1 one count.

When transfer arms 66 extend, a limit switch LS-5, actuated by a cam (not shown) on shaft 88 of motor 90, closes in line L-6 and opens in line L-20. The closing of limit switch LS-5 in line L-6 energizes relay CR-5, closing relay contacts CR-5 in holding-in line L-6A and line L-7. At the same time relay contact CR-5 in line L-19 opens to de-energize air valve solenoid AV-2 and exhaust air cylinders 60, thereby enabling the air springs to return the roll case to its "up" position.

When the roll case returns to its "up" position, limit switches LS-6 and LS-7 in line L-7 close, energizing a time delay relay TD-6, closing a relay contact TD-6 in line 7-A and opening a relay contact TD-6 in line L-6A. Also, a relay contact TD-6 in line L-21 is closed to energize a hydraulic valve solenoid HV-4 which reverses the direction of operation of transfer arm drive motor 90, retracting transfer arms 66 to strip sheet assemblies onto stacking arms 118.

With the transfer arms fully retracted, a limit switch LS-8 in line L-21 is opened by the motor shaft cam, shutting off the transfer arm drive motor 90. This completes a sheet transfer cycle, and the roll case is conditioned for receiving the next sheet assembly.

When the time delay relay TD-6 is energized to retract transfer arms 66 by the return of the roll case to its "up" position, another relay contact TD-6 in line L-15 is closed, energizing a relay CR-16. Relay CR-16, when energized, closes a relay contact CR-16 in line L-27B, energizing a hydraulic valve solenoid HV-10 in line L-27 to extend stacking arm cylinder 130 (FIG. 1) and thereby lower stacking arms 118. However, the stacking arms descend only a short distance, until the time delay relay TD-6 times out. When relay TD-6 times out, a delay contact TD-6 in line L-15 opens, thereby de-energizing relay CR-16 to open the CR-16 contact in line L-27B to de-energize hydraulic valve solenoid HV-10 which controls the extension of stacking arm cylinder 130. The foregoing control means comprises a portion of the stacking arm and, as will later be apparent, accumulator arm indexing means.

Upon receipt of the next sheet assembly on the roll case, the foregoing-described sequences are repeated, beginning with the closing of roll case limit switches LS-1A, LS-2 and LS-1 in line L-3 by the sheet assembly itself to energize relay CR-3 and drop the roll case to its down position.

When the sheet counter SC-1 has counted out a preselected number of sheets (by counting the number of times the roll case has dropped to its down position), the sheet counter contact SC-1 in line L-14 closes. This energizes a time delay relay TD-14 and closes a relay contact TD-14 in the holding-in line L-14A, opens contacts TD-14 in lines L-4 and L-13, and closes a delay contact TD-14 in line L-4A of the sheet counter circuit to reset the counter. At the same time, a relay contact TD-14 in line L-27 closes to energize the hydraulic valve solenoid HV-10, thereby extending the stacking arm operating cylinder 130 to lower the stacking arms continuously to their lower limit position below the transfer conveyor 24. The stack of sheet assemblies is thus deposited on the transfer conveyor 24. When the stacking arms reach their lower limit position, a limit switch LS-16 (see FIG. 12) in line L-14 opens to de-energize time delay relay TD-14, thereby opening relay contact TD-14 in line L-27 to de-energize hydraulic valve solenoid HV-10 and its associated stacking arm cylinder 30.

When time delay relay TD-14 is energized as previously described, a relay contact TD-14 in line L-8 also closes, energizing a relay CR-7 to close relay contacts CR-7 in lines L-8A, L-9 and L-22. The closing of contact CR-7 in lines L-22 energizes a hydraulic valve solenoid HV-5, which operates the hydraulic motor 162 (FIG. 6) in a direction to extend accumulator arms 150. This occurs at the same time that stacking arms 118 are lowering to their lower limit position, whereby the accumulator arms are positioned at the stacking station 16 to receive additional sheet assemblies S-3 (FIG. 1A) from the transfer arms as the stacking arms unload a stack of sheet assemblies S-2 on transfer conveyor 24.

When the accumulator arms are fully extended, a limit switch LS-10 in line L-9 closes, energizing a relay CR-10 to close relay contacts CR-10 in lines L-10 and L-11, and opening a relay contact CR-10 in line L-8. With the relay contact CR-10 closed in line L-10, the accumulator arms will jog downwardly a short distance each time they receive an additional sheet assembly from the transfer arms. This is accomplished as previously described with respect to the stacking arms via the indexing means comprising time delay relay TD-6 in line L-7 and the relay CR-16 in line L-15. The latter relay when energized closes the CR-16 contact in line L-10 for a short duration to energize a relay CR-11 which in turn closes a relay contact CR-11 in line 24 to energize hydraulic valve solenoid HV-7 for only a short duration, until the delay relay TD-6 times out to open its TD-6 contact in line L-15.

When the accumulator arms are extended to receive sheet assemblies, they jog downwardly in generally the same manner and through the same distance as the stacking arms upon receipt of each sheet assembly from the transfer arms, so that the upper level of a stack of sheets on the accumulator arms or stacking arms, as the case may be, always remains slightly below the level of the transfer arms so that each time such arms extend, they clear the stack. Each new assembly is then stripped from the transfer arms as they retract, and the sheets drop only a short distance onto either the stacking arms or the accumulator arms, whichever happen to be in position for receiving the sheets at the time.

As previously described, when the stacking arms reach their lower limit position, the time delay relay TD-14 is de-energized. When this occurs, the relay contact TD-14 in line L-13 re-closes. However, a photocell PC-14 in line L-16 (also see FIG. 12) has a contact PC-14 in line L-13 which opens in the presence of a stack of sheet assemblies S-2 (FIG. 1A) on transfer conveyor 24. When the transfer conveyor moves the stack out of the path of photocell PC-14, thereby indicating that such stack has cleared arms 118, photocell contact PC-14 in line 13 closes to complete a circuit through line L-13 and energize a relay CR-8. Relay contacts CR-8 in holding-in line L-13A and line 26 close to energize a hydraulic valve solenoid HV-9 which retracts stacking arm cylinder 130 to raise stacking arms 118.

Stacking arms 118 move upwardly until they envelop accumulator arms 150 in the nested relationship shown in FIG. 7. At this point the upper flanges 174 of the stacking arms are above the upper level of the accumulator arms and therefore relieve the latter arms of their load. Side plates 129 of stacking arm carriage 129 abut a corresponding side plate of the accumulator carriage to prevent the stacking arms from damaging the accumulator arms. A limit switch LS-11 in line L-11 closes, energizing a relay CR-12 which closes relay contacts CR-12 in holding-in line L-11A and line L-12. Energized relay CR-12 also opens a relay contact CR-12 in line L-13 to de-energize relay CR-8 which deactivates hydraulic valve soldnoid HV-9 in line L-26 to stop the ascent of the stacking arms. The relay CR-12 when energized also closes a relay contact CR-12 in line L-23 to energize a hydraulic valve solenoid HV-6 which reverses the operation of hydraulic motor 162 to retract accumulator arms 150. When the accumulator arms retract fully, they close a limit switch LS-12 in line L-12 to energize a relay CR-13. Relay CR-13 when energized closes relay contacts CR-13 in holding-in line L-12A and line L-25 to energize a hydraulic valve solenoid HV-8 which retracts accumulator arm cylinder 176 to return the accumulator arms to their upper limit position.

When the accumulator arms reach their upper limit position, a limit switch LS-13 opens, de-energizing relay CR-13, and thereby de-energizing solenoid HV-8 in line 25 to stop the retraction of accumulator arm cylinder 176. When this occurs, the stacking, unloading and accumulating cycle is complete, and the stacking arms again receive sheets directly from the transfer arms. Thereafter the foregoing-described sequence of operations with respect to the stacking and accumulator arms repeats, beginning with the jogging down of the stacking arms a short distance each time they receive a new sheet assembly from the transfer arms. When the stacking arms receive a preselected number of sheet assemblies, as preset on counter SC-1, the stacking arms descend to their lower limit position to unload the stack onto the transfer conveyor, while at the same time the accumulator arms extend, receive additional sheet assemblies from the transfer arms, and jog down upon receipt of each new sheet assembly.

From the foregoing description, it will be apparent that the sequencing of the transfer, stacking, unloading, and accumulating functions of the apparatus is entirely automatic, triggered only by the presence of a sheet assembly on the roll case. Also, any adjustments required for different sheet thicknesses are made through appropriate adjustment of the timing of time delay relays TD-6 and TD-14.

If desired, it is also possible to operate the apparatus manually via pushbutton controls which are also shown in the disclosed circuit of FIGS. 13A and 13B.

Line L-18A has an optional manual switch 202 which, when closed, operates solenoid valve HV-1 to operate the rolls. Another optional manual switch 204 in line 19A, when depressed, completes the circuit through line L-19 to operate the air valve solenoid AV-2, thereby dropping the roll case to its down position.

A pushbutton switch 206 in line L-20A when closed completes a circuit through line L-20 to extend the transfer arms. When such switch is depressed, an interlock contact 206 in line L-21 opens to prevent any simultaneous attempt to retract such arms.

A manual switch 208 in line L-21A, when depressed, closes a circuit through line L-21 to operate hydraulic valve solenoid HV-4 and retract the transfer arms. Such switch is interlocked with a switch contact 208 in line L-20 to prevent any simultaneous attempt to extend the arms.

Another manual switch 210 in line L-22A, when depressed, completes a circuit through line L-22 to energize hydraulic valve solenoid HV-5 to extend the accumulator arms. Switch 210 is interlocked with switch contact 210 in line L-23 which opens when there is a circuit completed through line L-22 to prevent completion of circuits through both lines at the same time should switch 212 in line 23-A be depressed simultaneously with switch 210.

Manual switch 212 in line L-23A when depressed completes a circuit through line L-23 to energize hydraulic valve solenoid HV-6 to retract the accumulator arms.

A pushbutton switch 214 in line L-24A, when depressed, completes a circuit through line L-24 to energize hydraulic valve solenoid HV-7 which lowers the accumulator arms. Similarly, a pushbutton switch 216 in line L-25A, when depressed, completes a circuit through line L-25 to energize the hydraulic valve solenoid HV-8, which returns the accumulator arms to their upper limit position.

Another pushbutton switch 218 in line L-26A, when depressed, completes a circuit through line L-26 to energize hydraulic valve solenoid HV-9 and raise the stacking arms.

There is also a pushbutton switch 220 in line L-27A which, when closed, completes a circuit through line L-27 to energize hydraulic valve solenoid HV-10 to lower the stacking arms.

All of the foregoing described manual switches are interlocked with switch contacts which open in a circuit which controls an opposing function to prevent operation of opposing functions should their control switches be depressed at the same time. For example, should the stacking arm "up" switch 218 be depressed at the same time that the stacking arm "down" switch 220 is depressed, nothing would happen because their interlocked contacts would open to prevent energizing of either hydraulic valve solenoid HV-9 or hydraulic valve solenoid HV-10.

Figure 12:
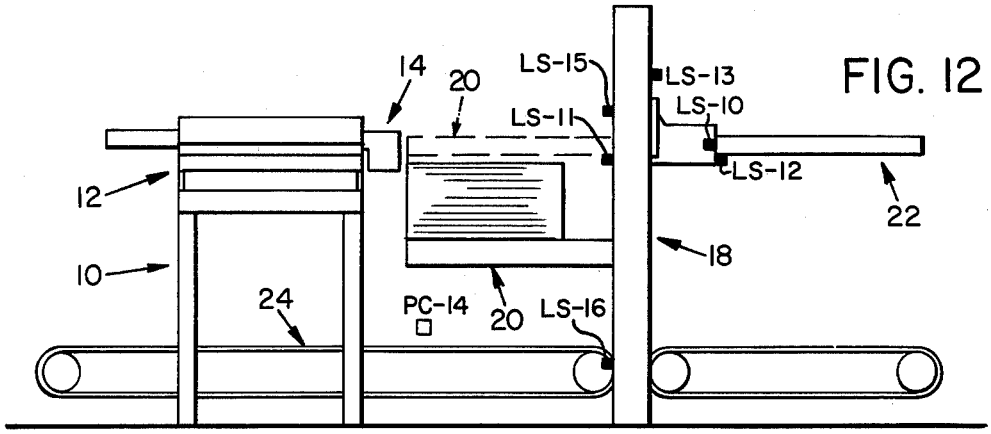

The various limit switches and photocell identified above are positioned on the machine components at the approximate locations shown in FIGS. 11 and 12.

Having illustrated and described the principles of my invention by what is presently a preferred embodiment, it should be apparent to those skilled in the art that such embodiment may be modified in arrangement and detail without departing from such principles. I claim as my invention all such modifications as come within the scope of the following claims.

I claim:

1. Apparatus for transferring sheet material to a stacking station comprising:

vertically reciprocative but horizontally stationary infeed conveyor case means, vertically stationary but horizontally reciprocative transfer arm means positionable between conveyor elements of said conveyor case means, said conveyor case means being movable vertically between a raised position for receiving sheet material and a lowered position for depositing said sheet material on said transfer arm means, said transfer arm means being shiftable horizontally between a retracted position between said conveyor elements and an extended position at said sheet-stacking station, said transfer arm means having sheet material support surfaces at a level below sheet material support surfaces of said conveyor elements when said conveyor case means is in its raised position, but above said support surfaces of said conveyor elements when said conveyor case means is in its lowered position, stacking means for stacking sheet material at said stacking station, said stacking means including horizontally stationary but vertically downwardly indexing stacking arm means at said stacking station, said stacking arm means extending parallel to but being laterally offset from said transfer arm means, said stacking arm means being indexable vertically between an upper limit position at a level no higher than that of said transfer arm means and a lower limit position substantially below the level of said transfer arm means for unloading a stack of sheet material therefrom, said stacking arm means being cantilevered toward said conveyor case means from a stacking arm support frame spaced on the opposite side of said stacking station from said conveyor case means, and a transfer conveyor means at a lower portion of said stacking station for receiving a stack of sheet material from said stacking arm means, said conveyor case means and said transfer arm means being supported on a stationary main frame and said stacking means being supported on a separate stacking support frame, said stationary main and support frames straddling opposite sides of said transfer conveyor, said transfer conveyor extending horizontally from the lower limits of said stacking station in opposite directions beneath said main and support frames, said main and support frames including upright support means astride opposite sides of said transfer conveyor means and cross frame portions bridging said transfer conveyor means and interconnecting said upright support means at distances above said conveyor means such that said main and support frames define load passages beneath their respective cross frame portions enabling said transfer conveyor means to transfer a stack of sheet material in either direction from said stacking station beneath said main and support frames.

2. Apparatus for transferring sheet material to a stacking station comprising:

vertically reciprocative but horizontally stationary infeed conveyor case means, vertically stationary but horizontally reciprocative transfer arm means positionable between conveyor elements of said conveyor case means, said conveyor case means being movable vertically between a raised position for receiving sheet material and a lowered position for depositing said sheet material on said transfer arm means, said transfer arm means being shiftable horizontally between a retracted position between said conveyor elements and an extended position at said sheet-stacking station, said transfer arm means having sheet material support surfaces at a level below sheet material support surfaces of said conveyor elements when said conveyor case means is in its raised position, but above said support surfaces of said conveyor elements when said conveyor case means is in its lowered position, stacking means for stacking sheet material at said stacking station, said stacking means including horizontally stationary but vertically downwardly indexing stacking arm means at said stacking station, said stacking arm means extending parallel to but being laterally offset from said transfer arm means, said stacking arm means being indexable vertically between an upper limit position at a level no higher than that of said transfer arm means and a lower limit position substantially below the level of said transfer arm means for unloading a stack of sheet material therefrom, said stacking arm means being cantilevered toward said conveyor case means from a stacking arm support frame spaced on the opposite side of said stacking station from said conveyor case means, sheet accumulator means comprising horizontally reciprocative and vertically downwardly indexable accumulator arm means carried by said stacking arm support frame, said accumulator arm means being movable horizontally between a retracted inactive position offset from said stacking station and an extended active position at said stacking station for receiving sheet material from said transfer arm means, said accumulator arm means being indexable downwardly from a raised position at a level no higher than said transfer arm means to a lowered position substantially below the level of said transfer arm means but above said lowered position of said stacking arm means, and wherein said support frame includes a pair of transversely spaced-apart upright support columns, a first stacking arm carriage means movable vertically along said support columns supporting said stacking arm means, and a second accumulator arm carriage means movable vertically along said columns above said first carriage means and supporting said accumulator arm means.

3. Apparatus according to claim 2 wherein said first carriage means includes a pair of carriage end members in rolling engagement with said columns, a stacking arm support beam spanning the distance between said columns and connected at opposite ends to said carriage end members, said stacking arm means comprising multiple parallel and transversely spaced-apart stacking arms affixed to said beam and cantilevered therefrom.

4. Apparatus according to claim 3 including a stacking arm indexing means for indexing said first carriage means downwardly on said support frame, said indexing means including flexible support means supporting said carriage end members on said columns, extensible fluid cylinder means connected to said flexible support means in a manner such that extension and retraction of said cylinder means causes a lowering and raising of said first carriage means, and control means for extending said cylinder means in predetermined increments to index said first carriage means downwardly upon each delivery of sheet material thereto.

5. Apparatus according to claim 3 wherein said second carriage means includes a second pair of carriage end members in rolling engagement with said columns and a second support beam spanning the distance between said columns above said stacking arm support beam, said accumulator arm means comprising multiple accumulator arms arranged in parallel transversely spaced relationship parallel to said stacking arms, said second support beam supporting said multiple accumulator arms for horizontal reciprocation.

6. Apparatus according to claim 5 wherein said second support beam includes multiple hanger members suspended from said support beam, each hanger member mounting an accumulator arm for horizontal reciprocation, and reciprocating means carried by said hanger means for reciprocating said accumulator arms relative to said hanger means.

7. Apparatus according to claim 5 including accumulator arm indexing means operable to index said second carriage means downwardly on said support frame, said accumulator arm indexing means comprising extensible fluid cylinder means mounted on said support frame and connected to said accumulator arm support beam for raising and lowering said second carriage means and control means for extending said cylinder means in increments to index said second carriage means downwardly upon each delivery of sheet material to said accumulator arms in their extended position.

8. Apparatus for transferring sheet material to a stacking station comprising:

vertically reciprocative but horizontally stationary infeed conveyor case means, vertically stationary but horizontally reciprocative transfer arm means positionable between conveyor elements of said conveyor case means, said conveyor case means being movable vertically between a raised position for receiving sheet material and a lowered position for depositing said sheet material on said transfer arm means, said transfer arm means being shiftable horizontally between a retracted position between said conveyor elements and an extended position at said sheet-stacking station, said transfer arm means having sheet material support surfaces at a level below sheet material support surfaces of said conveyor elements when said conveyor case means is in its raised position, but above said support surfaces of said conveyor elements when said conveyor case means is in its lowered position, stacking means for stacking sheet material at said stacking station, said stacking means including horizontally stationary but vertically downwardly indexing stacking arm means at said stacking station, said stacking arm means extending parallel to but being laterally offset from said transfer arm means, said stacking arm means being indexable vertically between an upper limit position at a level no higher than that of said transfer arm means and a lower limit position substantially below the level of said transfer arm means for unloading a stack of sheet material therefrom, said stacking arm means being cantilevered toward said conveyor case means from a stacking arm support frame spaced on the opposite side of said stacking station from said conveyor case means, sheet accumulator means comprising horizontally reciprocative and vertically downwardly indexable accumulator arm means carried by said stacking arm support frame, said accumulator arm means being movable horizontally between a retracted inactive position offset from said stacking station and an extended active position at said stacking station for receiving sheet material from said transfer arm means, said accumulator arm means being indexable downwardly from a raised position at a level no higher than said transfer arm means to a lowered position substantially below the level of said transfer arm means but above said lowered position of said stacking arm means, and wherein said accumulator arm means comprises multiple parallel accumulator arms and said stacking arm means comprises multiple parallel stacking arms extending parallel to said accumulator arms, said accumulator arms being positioned when extended in vertical alignment with said stacking arms, and wherein said accumulator arms are nestable within said stacking arms, said accumulator arms having a sheet material support surface positioned at a level below a corresponding sheet material support surface of said stacking arms when said accumulator arms are nested within stacking arms, and wherein each said stacking arm is of generally U-shaped cross section, said arm opening upwardly for receiving an accumulator arm in nested relationship therewithin.

9. In an apparatus for transferring sheet material to a stacking station and stacking said material, a sheet-stacking apparatus comprising:

an upright support frame including a pair of transversely spaced-apart upright support columns, carriage means vertically movable on said columns and including a carriage beam extending horizontally between said columns, multiple parallel stacking arms cantilevered horizontally from said carriage beam in transversely spaced relationship, and means for lowering and raising said carriage means on said support frame including indexing means for indexing said carriage means downwardly upon each receipt of sheet material on said stacking arms, and accumulator means carried by said support frame, said accumulator means comprising a second carriage means movable vertically along said columns above said first-mentioned carriage means, said second carriage means including a second carriage beam extending between said columns above said first-mentioned beam, and multiple parallel accumulator arms extending horizontally from said second beam parallel to said stacking arms, said accumulator arms being mounted on said second beam for horizontal reciprocation between a retracted position generally behind said stacking arms and an extended position overlying said stacking arms.

10. Apparatus according to claim 9 wherein said accumulator arms when in their extended positions are in vertical alignment with said stacking arms.

11. Apparatus according to claim 10 wherein said accumulator arms are nestable within said stacking arms and have a material-supporting surface below a corresponding material-supporting surface of said accumulator arms when so nested.

12. Apparatus according to claim 11 wherein each said stacking arm is of generally U-shaped cross section with flanged load-supporting upper surfaces, said U-shaped cross section opening upwardly so that said stacking arm can receive an accumulator arm therewithin when said stacking arm is raised to approximately the same level as its corresponding accumulator arm.

13. Apparatus according to claim 9 including means for extending and retracting said accumulator arms and means for indexing said accumulator arms downwardly upon receipt of sheet material thereon, said extending and retracting means including a length of roller chain attached to each said accumulator arm and reversible drive sprocket means on said second carriage and in driving engagement with said roller chain.

14. Apparatus according to claim 9 including control means or controlling the operation of said stacking arms and said accumulator arms in sequence as follows:

(a) indexing said stacking arms downwardly upon each delivery of sheet material thereto, (b) lowering said stacking arms to a lower limit position for unloading when said stacking arms index downwardly to a predetermined extent, (c) extending said accumulator arms from a retracted position for receiving sheet material when said stacking arms are lowered, (d) indexing said accumulator arms downwardly upon each delivery of sheet material thereto, (e) raising said stacking arms to the approximate level of said accumulator arms to transfer sheet material from said accumulator arms to said stacking arms, and (f) retracting said accumulator arms and raising them to an upper limit position.

* * * * *